US005308736A

United States Patent [19]

Defieuw et al.

[11] Patent Number: 5,308,736

[45] Date of Patent: May 3, 1994

[54] DYE-DONOR ELEMENT FOR USE ACCORDING TO THERMAL DYE SUBLIMATION TRANSFER

[75] Inventors: Geert H. Defieuw, Kessel-Lo; Herman J. Uytterhoeven, Bonheiden, both of Belgium; Rolf Wehrmann; Wolfgang Ebert, both of Krefeld, Fed. Rep. of Germany

[73] Assignee: Agfa-Gevaert, N.V., Mortsel, Belgium

[21] Appl. No.: 928,735

[22] Filed: Aug. 13, 1992

[30] Foreign Application Priority Data

Sep. 10, 1991 [GB] United Kingdom ..... 91202308

[51] Int. Cl.[5] ..... B41M 5/035

[52] U.S. Cl. ..... 430/200; 430/201; 503/227

[58] Field of Search ..... 430/200, 201, 203; 503/227; 524/280, 281; 588/270, 274

[56] References Cited

U.S. PATENT DOCUMENTS

| | | | |
|---|---|---|---|
| 2,189,205 | 2/1940 | Gretler et al. | 524/292 |
| 3,269,971 | 8/1966 | Goldblum | 524/281 |
| 4,098,751 | 7/1978 | Mark et al. | 524/281 |
| 4,876,236 | 10/1989 | Vanier et al. | 428/913 |
| 4,983,502 | 1/1991 | Ohbayashi et al. | 430/203 |
| 5,116,806 | 5/1992 | Vanmaele | 503/227 |

FOREIGN PATENT DOCUMENTS 61-286199 12/1986 Japan .

*Primary Examiner*—Charles L. Bowers, Jr.
*Assistant Examiner*—Martin J. Angebranndt
*Attorney, Agent, or Firm*—Breiner & Breiner

[57] ABSTRACT

Dye-donor element for use according to thermal dye sublimation transfer comprising a support having on one side thereof a dye layer and containing a substituted di(hetero)aryl carbonate as thermal solvent.

10 Claims, No Drawings

DYE-DONOR ELEMENT FOR USE ACCORDING TO THERMAL DYE SUBLIMATION TRANSFER

FIELD OF THE INVENTION

The present invention relates to a dye-donor element for use according to thermal dye sublimation transfer printing and more particularly to materials which can be added to the dye-donor element in order to improve the dye transfer efficiency.

BACKGROUND OF THE INVENTION

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

It is always desirable to transfer as much dye as possible with the lowest thermal energy in said thermal dye sublimation transfer systems. The amount of dye which can be transferred from a dye-donor element to a receiving element by thermal dye transfer depends upon the dye transfer efficiency. It is known to add so-called thermal solvents to the dye-donor element in order to increase the dye transfer efficiency and thus to obtain enhanced dye transfer densities. Thermal solvents are non-hydrolyzable organic compounds that are solid at ambient temperature but molten at elevated temperatures. They have a melting point between 40° C. and 300° C., preferably between 40° C. and 150° C. In molten state they act as a solvent within the element in which they are contained. These compounds are known under such different names like thermal solvents, melt-formers, melt-modifiers, eutectic formers, plasticizers, softeners, and thermal development and diffusion-promoting agents.

Various classes of thermal solvents have been described for use in thermal dye transfer donor elements, for example, in EP 318944, EP 318945, EP 390044, JP 56/89985, JP 59/222391, JP 60/44392, JP 60/56590, JP 61/286199, JP 62/108086, JP 62/283176, JP 02/3384, JP 02/25387, JP 02/151485 and JP 03/10891.

Diphenyl compounds with various linking groups between the two phenyl nuclei have also been described as thermal solvents in dye-donor elements. Examples of linking groups described are esters (see EP 318945 and JP 61/286199), ketones (see EP 318944), (sulfon)amides (see EP 318944) and ethers (see JP 02/3384 and JP 02/25387).

In EP 318945 non-substituted diphenyl carbonates are used as thermal solvent in the dye-donor element. Although these compounds have a beneficial effect on dye transfer they adversely affect the stability of the donor element. When dye-donor elements having such dye layers containing non-substituted diphenyl carbonates as thermal solvents have been rolled up and stored for any length of time such that the backcoat of one portion of the donor element is held against the dyecoat of another portion, sticking of the backcoat to the dyecoat occurs and migration of the dye takes place leading to a loss of density of any prints eventually made using that donor element. Further said thermal solvents cause crystallization of the dye.

SUMMARY OF THE INVENTION

Therefore it is an object of the present invention to provide thermal solvents for incorporation in the dye-donor element not having the disadvantages mentioned above.

According to the present invention there is provided a dye-donor element for use according to thermal dye sublimation transfer comprising a support having on one side thereof a dye layer and containing a thermal solvent, characterized in that said thermal solvent is a substituted di(hetero)aryl carbonate.

By (hetero)aryl is meant aryl or heteroaryl.

Dye-donor elements containing thermal solvents according to the present invention provide an increase in dye transfer efficiency. Further these compounds do not have a detrimental effect on the stability of the donor element stored in folded or rolled form.

DETAILED DESCRIPTION OF THE INVENTION

Thermal solvents according to the present invention are substituted di(hetero)aryl carbonates wherein the (hetero)aryl group is selected from the group consisting of phenyl, naphthyl, thiophene and pyridine. The two (hetero)aryl groups may be the same or may be different. Substituents on the (hetero)aryl groups include alkyl groups, cycloalkyl groups, aralkyl groups, aryl groups, alkoxy groups, aryloxy groups, acyl groups, ester groups, amide groups, amine groups, ether groups, carbonate groups, which groups may be substituted, halogen atoms, hydroxy groups, nitrite groups.

According to a preferred embodiment of the present invention the substituted di(hetero)aryl carbonate corresponds to the following formula

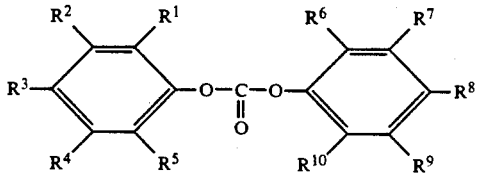

wherein: each of $R^1$ to $R^{10}$ (same or different) represents hydrogen, an alkyl group, a cycloalkyl group, an aralkyl group, an aryl group, an alkoxy group, an aryloxy group, an acyl group, an ester group, an amide group, an amine group, an ether group, a carbonate group, which groups may be substituted, a halogen atom, an hydroxy group, a nitrile group, with the proviso that at least one of $R^1$ to $R^{10}$ does not represent hydrogen.

Preferably only one of $R^1$ to $R^5$ (preferably $R^3$) and only one of $R^6$ to $R^{10}$ (preferably $R^8$) does not represent hydrogen and preferably both of these substituents are the same. Preferred substituents are alkyl groups (e.g. t-butyl, methyl, ethyl and 1-ethylhexyl), cycloalkyl groups (e.g. cyclohexyl), aryl groups and aralkyl groups (e.g. 2-phenyl-2-propyl). Preferably, the sum of the molecular weights of the substituents is between 30 and 300.

The thermal solvents described above may be incorporated directly into the dye layer of the dye-donor element or in an adjacent layer where they will be in effective contact with the dye layer during the transfer process. They may be employed in any amount which is effective for the intended use. In general, good results have been obtained at a coverage of from 0.05 to 0.3 $g/m^2$ or at a concentration of from 30% to 300% by weight of coated dye or from 1% to 50% by weight of dye layer binder.

The thermal solvents according to the present invention may be used in combination with other thermal solvents known for use in thermal dye transfer donor elements. Examples of such thermal solvents are the thermal solvents described in US 3438776, DE 3339810, EP 119615, EP 327318 and further carboxylic acids and esters thereof such as glutaric acid, sebacic acid, citric acid or citric acid anhydride, ascorbic acid, benzoic acid, toluic acid, p-hydroxybenzoic acid, salicylic acid; fatty acids e.g. stearic acid, 12-hydroxystearic acid, methylstearate, biphenylsuberate; sulfonic acids such as benzenesulfonic acid, p-toluenesulfonic acid; alcohols such as 1-octadecanol, 1,6-hexanediol, 1,8-octanediol, is 1,10-decanediol; sugars such as fructose, sorbitol; phenols and their derivatives such as resorcinol, α-naphthol, 2,3-dimethylphenol, p-decylphenol, p-methoxyphenol, p-(2-phenylethoxy)phenol; sulfonamides such as sulfamide, methylsulfonamide, N,N'-dicyclohexylsulfonamide; amides such as acetamide, N-methylacetamide, stearamide; imides such as succinimide, 20, N-hydroxysuccinimide; amines such as α-napthylamine, triphenylamine; ureas such as urea, methylurea, N,N'-dimethylurea, N,N'-dicyclohexylurea, 1,3-dimethyl-2-imidazolidinone, N,N'-dimethyl-N,N'-propylene urea, thiourea, hydantoine; naphthalene derivatives such as 2-methoxynaphthalene; hydroquinone derivatives such as hydroquinone dichloromethylester.

Any dye can be used in the dye layer of the dye-donor element of the present invention provided it is transferable to the dye-receiving layer by the action of heat. Especially good results have been obtained with sublimable dyes such as described in EP 432829, EP 432313, EP 432314, EP 400706, EP 485665, European patent application No. 91200218.5 and EP 453020. In order to minimize catalytic fading of these dyes they can be used in combination with indoaniline dyes as described in e.g. U.S. Pat. No. 5,024,990 and U.S. Pat. No. 5026679.

Examples of other suitable dyes are dyes corresponding to the following formulae

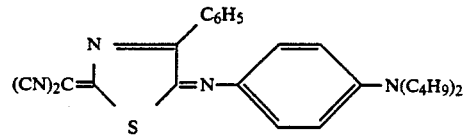

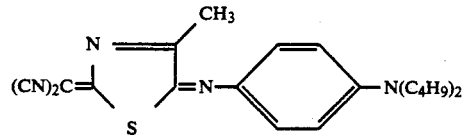

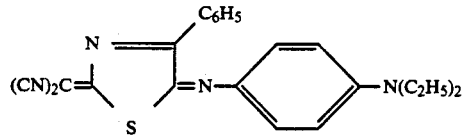

which dyes can be synthesized in an analoguous manner as described in EP 362808.

The dye layer of the thermal dye sublimation transfer donor element according to the present invention is formed preferably by adding the dyes, the polymeric binder medium, the substituted di(hetero)aryl carbonate thermal solvent and other optional components to a suitable solvent or solvent mixture, dissolving or dispersing the ingredients to form a coating composition that is applied to a support, which may have been provided first with an adhesive or subbing layer, and dried. Usually the layer is dried in air having a temperature of about 90° C. to about 130° C., preferably 100° C. to 120° C. depending upon the solvent used.

The dye layer thus formed has a thickness of about 0.2 to 5.0 um. preferably 0.4 to 2.0 um, and the amount ratio of dye or dye mixture to binder is between 9:1 and 1:3 by weight, preferably between 3:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or poly(styrene-co-acrylonitrile) is used as binder for the dye layer of the present invention.

The coating layer may also contain other additives, such as stabilizers, curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

The dye layer or a layer adjacent to the dye layer may further comprise so-called heat amplication agents which decompose and undergo an exothermic reaction within the operative temperature range of the dye transfer. Application of a heat pulse is merely a trigger to cause the exothermic compound to locally produce heat, which aids in transferring the dye(s) and thus in increasing the dye density of the transferred image. Examples of such heat amplication agents, also called blowing agents are described in e.g. EP 113017, EP 150383, U.S. Pat. No. 4525722, Handbook of Reactive Chemical Hazards, third edition, Butterworths, London, page 1461–1462. Other suitable heat amplification agents are: 2,2'-azodiisobutyronitrile, dimethyl-2.2'-azobisisobutyrate, 2,2'-azobis(isobutyramide), 2,2'-azobis(2-methyl-N-(2-hydroxyethyl)propionamide), 2,2'-azobis(2-methyl-N-(1,1-bis (hydroxymethyl)ethyl)-propionamide, 2,2'-azobis(2-methyl-N-(1,1-bis (hydroxymethyl)-2-hydroxyethyl)propionamide), 2,2'-azobis(2-methyl-N-phenylpropionamidine), 2,2'-azobis(N-(4-chlorophenyl)-2-methylpropionamidine), 2,2'-azobis(N-(4-hydroxyphenyl)-2-methylpropionamidine), 2,2'-azobis(N-(4-aminophenyl)-2-methylpropionamidine), 2,2'-azobis(2-methyl-N-(phenylmethyl)-propionamidine), 2.2'-azobis(2-methyl-N-2-propenyl-propionamidine), 2,2'-azobis(2-methylpropionamidine), 2,2'-azobis(N-(2-hydroxyethyl)-2-methylpropionamidine), 2,2'-azobis(2-methyl-N-(1,1-bis(hydroxymethyl)-2-hydroxyethyl) propionamidine), 2,2'-azobis(2-methyl-N-(1,1-bis (hydroxymethyl)ethyl)propionamidine), 2,2'-azobis(2-methyl-N-(2-hydroxyethyl) propionamidine), 2,2'-azobis(2-methylpropionamidine), 2,2'-azobis(2,4,4-trimethylpentane), 2,2'-azobis(2-methylpropane), dimethyl 2,2'-azobis(2-methylpropionate), 4,4'-azobis(4-cyanovaleric acid), 2,2'-azobis(2-(hydroxymethyl)propionitrile), 1,1'-azobis-1-cyclohexane carbonitrile, dibenzoylperoxide, benzenesulfonic acid hydrazide, 3-dodecylsulfonamidobenzenesulfonic acid hydrazide, 4-(1,1-dimethyldecyl)sulfonamidobenzenesulfonic acid hydrazide, 3-methylcarbonylamino-4-hexadecylsulfobenzenesulfonic acid hydrazide, decylsulfonic acid hydrazide and commercially available sulfonhydrazides sold under the tradename GENITRON OB by FBC Industrial Chemicals, Cambridge, England.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, pollyimides, glassine paper and condenser paper. Preference is given to a support comprising polyethylene terephthalate. In general, the support has a thickness of 2 to 30 um. The support may also be coated with an adhesive or subbing layer, if desired. Examples of suitable subbing layers are described, for example, in EP 433496, EP 311841, EP 268179, U.S. Pat. No. 4727057, U.S. Pat. No. 4695288.

The dye layer of the dye-donor element may be coated on the support or printed thereon by a printing technique such as a gravure process.

On top of the dye layer a layer may be provided to reduce or inhibit fog i.e. transfer of dye on the non-heated areas induced by pressing the donor element against the receiving element. Polymeric binders for use in such a layer must be dye-permeable, must have a sufficiently high glass transition temperature and must be sufficiently abhesive so that the layer does not stick to the receiving element during peeling-off. Further the polymeric binder must be sufficiently soluble in a solvent that will not dissolve the underlying dye layer during coating of the toplayer. Examples of suitable polymeric binders are: nitrocellulose, poly(vinylbutyral-co-vinylacetal-co-vinylalcohol) (PIOLOFORM BL 16 sold by Wacker) and a copolyester of terephthalic acid, isophthalic acid, sulfoisophthalic acid sodium salt and ethyleneglycol. The layer must be sufficiently thin; in general the polymeric binder is coated at a coverage of 0.1 to 0.3 g/m$^2$.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. No. 4567113, U.S. Pat. No. 4572860, U.S. Pat. No. 4717711. Preferably the slipping layer comprises as binder a styrene-acrylonitrile copolymer or a styrene-acrylonitrile-butadiene copolymer or a mixture hereof or cellulose esters and as lubricant in an amount of 0.1 to 10 % by weight of the binder (mixture) a polysiloxane-polyether copolymer or polytetrafluoroethylene or a mixture hereof.

The support for the receiver sheet that is used with the dye-donor element may be a transparant film of e.g. polyethylene terephthalate, a polyether sulfone, a polyamide, a cellulose ester or a polyvinyl alcohol-co-acetal.

The support may also be a reflective one such as baryta-coated paper, polyethylene-coated paper or white polyester i.e. white-pigmented polyester. Blue-colored polyethylene terephthalate film can also be used as support.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, polystyrene-co-acrylonitrile, polycaprolactone or mixtures thereof. Suitable dye-receiving layers have been described in e.g. EP 133011, EP 133012, EP 144247, EP 227094, EP 228066. The dye-image-receiving layer may also comprise a cured binder such as the heat-cured product of poly(vinylchloride-co-vinylacetate-co-vinylalcohol) and polyisocyanate.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye-image receiving layer may be coated on the support by any suitable coating technique e.g. by bar coating. The layer is subsequently dried in air having a temperature of about 90° C. to about 120° C.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agent solid waxes, fluorine- or phosphate-containing surfactants and silicone oils are used. Suitable releasing agents are described in e.g. EP 133012, JP 85/19138, EP 227092.

The thermal dye sublimation transfer printing process comprises placing the dye layer of the donor element in face-to-face relation with the dye-receiving layer of the receiver sheet and imagewise heating from the back of the donor element. The transfer of the dye is accomplished by heating for about several milliseconds at a temperature of about 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLES

A dye-donor element for use according to thermal dye sublimation transfer was prepared as follows:

A solution comprising 5 wt% dye A, 3 wt% dye B (B1 or B2), 3 wt% dye C, 6 wt% of poly(styrene-co-acrylonitrile) as binder and a thermal solvent the nature and amount (in wt%) of which is indicated in table 1 below in methylethylketone as solvent was prepared. From this solution a layer having a wet thickness of 10 um was coated on 6 um thick polyethylene terephthalate film. The resulting layer was dried by evaporation of the solvent.

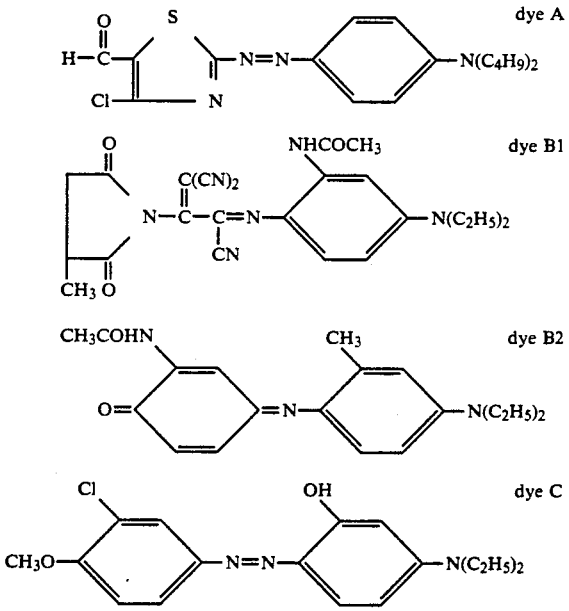

The back side of the polyethylene terephthalate film was provided with a slipping layer coated from a solution containing 13 wt% poly(styrene-co-acrylonitrile) binder and 1 wt% polysiloxane-polyether copolymer lubricant.

The commercially available material type CP 100TS sold by Mitsubishi was used as receiving element (A).

A receiving element (B) for use according to thermal dye sublimation transfer was prepared as follows:

A receiving layer containing 7.2 g/m$^2$ poly(vinylchloride-co-vinylacetate-co-vinylalcohol) (VINYLITE VAGD supplied by Union Carbide), 0.72 g/m$^2$ dilsocyanate (DESMODUR VL supplied by Bayer AG) and 0.2 g/m$^2$ hydroxy modified polydimethylsiloxane (TEGOMER H SI 2111 supplied by Goldschmidt) was provided on a 170 μm thick blue-colored polyethylene is teraphthalate film.

The dye-donor element was printed in combination with the receiving element (A or B) in a Mitsubishi color video printer CP100E.

The receiver sheet was separated from the dye-donor element and the dye transfer efficiency was determined according to the following formula $$Eff=(D_0-D_1)/D_0\times 100$$

wherein $D_0$ is the transmission color density of the non-printed donor element and $D_1$ is the transmission color density of the donor element after printing. The color densities are measured in the red, green and blue region by means of a Macbeth TD102 densitometer equipped with Wratten filters 92, 93 and 94.

Sticking of the slipping layer to the dye layer occurring in the non-printed donor element in rolled or folded form was checked by storing t donor element in rolled form for 1 hour at 60° C. (stability of the donor element).

This experiment was repeated for each combination of dye-donor element and receiving element identified in table 1 below. The results are listed in table 1 below.

TABLE 1

| thermal | solvent | | dye transfer efficiency | | | | | | |
|---|---|---|---|---|---|---|---|---|---|
| | | | receiver A | | | receiver B | | | |
| type | amount | dyes | red | blue | green | red | blue | green | stability |
| none | / | A, B1, C | 29 | 47 | 39 | 36 | 52 | 47 | good |
| I | 1 | A, B1, C | 40 | 58 | 52 | 44 | 60 | 57 | poor |
| I | 2.5 | A, B1, C | 45 | 63 | 58 | 50 | 66 | 64 | poor |
| II | 1 | A, B1, C | 44 | 61 | 55 | 44 | 59 | 56 | good |
| II | 2.5 | A, B1, C | 44 | 60 | 54 | 51 | 66 | 63 | good |
| III | 1 | A, B1, C | 37 | 55 | 54 | 48 | 63 | 60 | good |
| III | 2.5 | A, B1, C | 42 | 59 | 53 | 49 | 64 | 62 | good |
| IV | 1 | A, B1, C | 39 | 56 | 50 | 41 | 56 | 53 | good |
| IV | 2.5 | A, B1, C | 37 | 52 | 47 | 50 | 64 | 61 | good |
| V | 1 | A, B1, C | 36 | 54 | 48 | 46 | 61 | 59 | good |
| V | 2.5 | A, B1, C | 50 | 63 | 59 | 54 | 65 | 64 | good |
| VI | 1 | A, B1, C | 41 | 59 | 52 | 46 | 61 | 58 | good |
| VI | 2.5 | A, B1, C | 36 | 54 | 47 | 39 | 55 | 50 | good |
| none | / | A, B2, C | 58 | 59 | 66 | 63 | 65 | 69 | good |
| VII | 1 | A, B2, C | 62 | 65 | 68 | 67 | 70 | 70 | good |
| VIII | 1. | A, B2, C | 62 | 64 | 68 | 69 | 71 | 74 | good |

TABLE 1-continued

| thermal type | solvent amount | dyes | dye transfer efficiency receiver A red | receiver A blue | receiver A green | receiver B red | receiver B blue | receiver B green | stability |
|---|---|---|---|---|---|---|---|---|---|
| IX | 1 | A, B2, C | 62 | 64 | 66 | 69 | 72 | 72 | good |

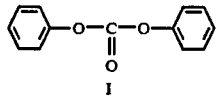

I

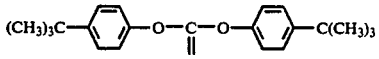

II

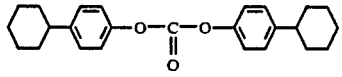

III

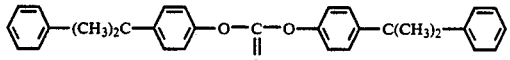

IV

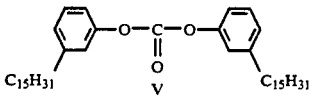

V

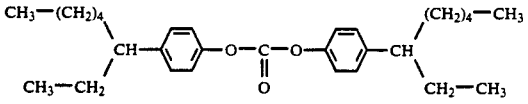

VI

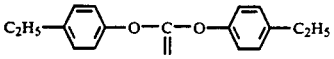

VII

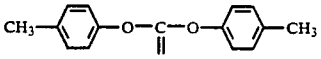

VIII

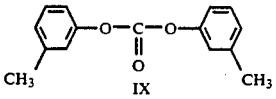

IX

These results show that thermal solvents according to the present invention yield high dye transfer efficiencies and improved stability of the donor element compared to diphenyl carbonate (compound I = comparison).

We claim:

1. Dye-donor element for use according to thermal dye sublimation transfer comprising a support having on one side thereof (i) a dye layer containing a dye and binder and (ii) a thermal solvent, said thermal solvent being a substituted di(hetero)aryl carbonate.

2. Dye-donor element according to claim 1, wherein the (hetero)aryl group is selected from the group consisting of phenyl, naphthyl, thiophene and pyridine.

3. Dye-donor element according to claim 1 wherein the two (hetero)aryl groups are the same.

4. Dye-donor element according to claim 1, wherein the substituents on the (hetero)aryl groups are selected from the group consisting of alkyl groups, cycloalkyl groups, aralkyl groups, aryl groups, alkoxy groups, aryloxy groups, acyl groups, ester groups, amide groups, amine groups, ether groups, carbonate groups, halogen atoms, hydroxy groups, nitrile groups.

5. Dye-donor element according to claim 1, wherein the substituted di(hetero)aryl carbonate corresponds to the following formula

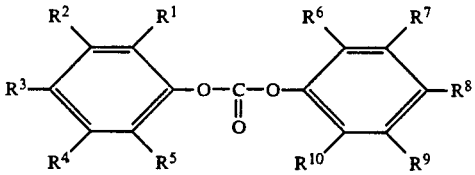

wherein:

each of $R^1$ to $R^{10}$ (same or different) represents hydrogen, an alkyl group, a cycloalkyl group, an aralkyl group, an aryl group, an alkoxy group, an aryloxy group, an acyl group, an ester group, an amide group, an amine group, an ether group, a carbonate group, a halogen atom, an hydroxy group, a nitrile group, with the proviso that at least one of $R^1$ to $R^{10}$ does not represent hydrogen.

6. Dye-donor element according to claim 5, wherein the sum of the molecular weights of the substituents $R^1$–$R^{10}$ is between 30 and 300.

7. Dye-donor element according to claim 5, wherein $R^3$ and $R^8$ both represent an alkyl group or a cycloalkyl group or an aryl group or an aralkyl group and wherein $R^1$, $R^2$, $R^4$ to $R^7$, $R^9$ and $R^{10}$ represent hydrogen.

8. Dye-donor element according to claim 1, wherein the di(hetero)aryl carbonate is contained in the dye layer.

9. Dye-donor element according to claim 8 wherein the amount of di(hetero)aryl carbonate is between 1 and 50% by weight of the dye layer binder.

10. Dye-donor element according to claim 9, wherein the binder is poly(styrene-co-acrylonitrile).

* * * * *